US005333002A

United States Patent [19]

Gans et al.

[11] Patent Number: 5,333,002

[45] Date of Patent: Jul. 26, 1994

[54] FULL APERTURE INTERLEAVED SPACE DUPLEXED BEAMSHAPED MICROSTRIP ANTENNA SYSTEM

[75] Inventors: Lawrence S. Gans, Sparta; Leonard Schwartz, Montville, both of N.J.

[73] Assignee: GEC-Marconi Electronic Systems Corp., Wayne, N.J.

[21] Appl. No.: 62,061

[22] Filed: May 14, 1993

[51] Int. Cl.[5] ..... H01Q 1/38; H01Q 11/02

[52] U.S. Cl. ..... 343/700 MS; 343/853; 343/737

[58] Field of Search ..... 343/700 MS, 705, 853, 343/737, 771, 731, 739, 893; H01Q 1/38, 1/28, 11/02, 21/00, 21/08

[56] References Cited

U.S. PATENT DOCUMENTS

| | | | |
|---|---|---|---|
| 4,180,818 | 12/1979 | Schwartz et al. | 343/700 MS |
| 4,347,516 | 8/1982 | Shrekenhamer | 343/700 MS |
| 4,605,931 | 8/1986 | Mead et al. | 343/700 MS |
| 4,644,360 | 2/1987 | Mead et al. | 343/700 MS |
| 4,780,723 | 10/1988 | Mead | 343/700 MS |

*Primary Examiner*—Donald Hajec
*Assistant Examiner*—Hoanganh Le
*Attorney, Agent, or Firm*—David L. Davis

[57] ABSTRACT

A full aperture interleaved space duplexed beamshaped microstrip antenna system wherein the separate transmit and receive microstrip antennas each has respective arrays of radiating patch elements. Each of the antennas is fed from a single end thereof so that each antenna creates four beams. Beam pitch angles are introduced into each antenna so as to reduce the coupling between adjacent lines to allow the gap within each connected line pair to be reduced. This gap reduction provides room for the antennas to be interleaved within a common rectangular aperture so that the separate feeds are at opposite ends of the aperture. Each antenna then utilizes the entire aperture. Isolation elements are provided between the lines of the transmit and receive antennas so as to reduce the mutual coupling therebetween and maintain the minimum required sixty dB isolation.

7 Claims, 7 Drawing Sheets

FULL APERTURE INTERLEAVED SPACE DUPLEXED BEAMSHAPED MICROSTRIP ANTENNA SYSTEM

BACKGROUND OF THE INVENTION

This invention relates to Doppler radar navigation systems and, more particularly, to an improved transmit/receive antenna system for such a navigation system which is particularly well adapted for overwater use and which utilizes the entire available aperture for each of the transmit and receive antennas so as to maximize antenna gain.

Antennas for overwater Doppler radar navigation systems must satisfy very stringent requirements. The type of antenna typically used for such an application is commonly referred to as a microstrip antenna and is formed as a planar printed circuit on a substrate, the circuit comprising an array of parallel lines of serially interconnected radiating rectangular patch elements. The antenna is mounted to the underbelly of an aircraft fuselage within a rectangular aperture formed by the ribs of the fuselage. Thus, the maximum size of the antenna is constrained by the spacing between the ribs. These Doppler antennas generate time shared beams within the defined aperture. Since beam width is inversely proportional to aperture size, and antenna gain is directly proportional to aperture size, one requirement is to utilize as much of the aperture as possible for each beam.

For Doppler systems that fly over both land and water, the navigation accuracy is impacted by a shift in the measured Doppler frequency due to the backscattering over water which is a function of the incidence angle (the angle from the vertical) and the actual sea state. The calmer the sea (the lower the sea state) the larger the Doppler error from land to sea because the sea has more of a mirror effect. It is therefore another requirement of such an antenna that it have the inherent ability to shape the beams so that they have contours which result in Doppler shifts which are essentially invariant with backscattering surface.

For FM/CW Doppler systems, the minimum required isolation between the transmit and receive antenna ports is sixty dB. This results in the requirement of two separate (space duplexed) transmit and receive antennas, rather than a single time duplexed antenna. Since these antennas must both occupy the same aperture, in the past this has limited the full usage of the aperture for each of the antennas and conflicts with the requirement for narrow beam width, as well as impacting on the achievable antenna gain.

Another requirement of such an antenna system is that it be inherently temperature and frequency compensated.

Planar microstrip antennas for Doppler radar navigation systems are well known. It is also known to slant the arrays in order to generate beams with particular contours to provide independence from overwater shift, as disclosed, for example, in U.S. Pat. No. 4,180,818, the contents of which are hereby incorporated by reference. U.S. Pat. No. 4,347,516, the contents of which are hereby incorporated by reference, discloses the application of the principles of the '818 patent to a rectangular antenna. However, the antenna according to the '516 patent only utilizes one half the available aperture for each of the beams. It is also known to interleave linear arrays so that the entire available aperture can be utilized for each beam and to use a crossover feed structure so that the antenna can be printed on only a single side of a substrate. Such structure is disclosed in U.S. Pat. No. 4,605,931, the contents of which are hereby incorporated by reference. However, the arrangement disclosed in the '931 patent provides all feeds from a single end of the antenna and only results in about half of the available aperture contributing to the shaping of each beam. When the width of an antenna employing the single-end feed scheme is reduced by half to accommodate a side-by-side space duplexed configuration, the portion of the aperture contributing to beamshaping is also reduced by half. This reduced aperture is then unable to provide the degree of beamshaping required for acceptable overwater performance.

As known to the Applicants herein, the current state of the art requires two separate space duplexed (side-by-side) antennas which divide the aperture into two parts, one for the receive antenna and one for the transmit antenna. One such configuration is described in the Applicants' co-pending U.S. patent application Ser. No. 07/980,270, filed Nov. 23, 1992. This application discloses a space duplexed beamshaped microstrip antenna system including transmit and receive antennas, each of which has two groups of interleaved arrays. The array groups are slanted in opposite directions and each is fed from opposite corners of the antenna so that each group utilizes its entire assigned reduced width aperture to create the required beam contours for two beams. Although the disclosed configuration provides the required sixty dB isolation between antennas and proper beamshaping, the disadvantage of two separate antennas, each filling half the aperture, is that each antenna has three dB lower gain than would an antenna which fills the entire aperture. Also, the cross-track beam width is twice what it would be if the entire aperture were utilized. This results in a cross-track velocity accuracy which is reduced by a factor of two. Thus, the ideal antenna for overwater Doppler radar navigation systems is one that would utilize the entire aperture for each of the transmit and receive antennas, and would also achieve the desired sixty dB of transmit/receive isolation.

Concerning a shared aperture, the current state of the art in terms of isolation is forty five dB, as described in U.S. Pat. No. 4,644,360, the contents of which are hereby incorporated by reference. This patent discloses separate receive and transmit interleaved arrays sharing a common aperture, each of the arrays being fed from both ends thereof. However, the separate transmit and receive feeds at the two ends are on the two opposite surfaces of the antenna substrate so that circuitry must be printed on both surfaces of the substrate and feed through connections are required.

It is therefore a primary object of the present invention to provide a transmit/receive antenna system in which the antennas share a common aperture so that the beam width is reduced and the gain is maximized, while still maintaining the required sixty dB isolation between the transmit and receive antennas.

It is another object of the present invention to provide an antenna system of the type described which can be entirely printed on only a single surface of a substrate.

SUMMARY OF THE INVENTION

The foregoing and additional objects are attained in accordance with the principles of this invention by providing separate transmit and receive microstrip antennas each having respective arrays of radiating patch elements. Each of the antennas is fed from a single end thereof and the antennas are interleaved within a common rectangular aperture so that the separate feeds are at opposite ends of the aperture. Isolation means is provided between the lines of the transmit and receive antennas so as to reduce the mutual coupling therebetween and maintain the minimum required sixty dB isolation.

In accordance with an aspect of this invention, the isolation means includes resistive material in a continuous line between the lines of the transmit and receive antennas.

In accordance with a further aspect of this invention, the arrays of each antenna are phased to introduce a pitch angle into each antenna to allow the spacing within each connected line pair of each of the antennas to be reduced so as to provide resultant gaps which permit the interleaving of the two full antennas within a common aperture.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
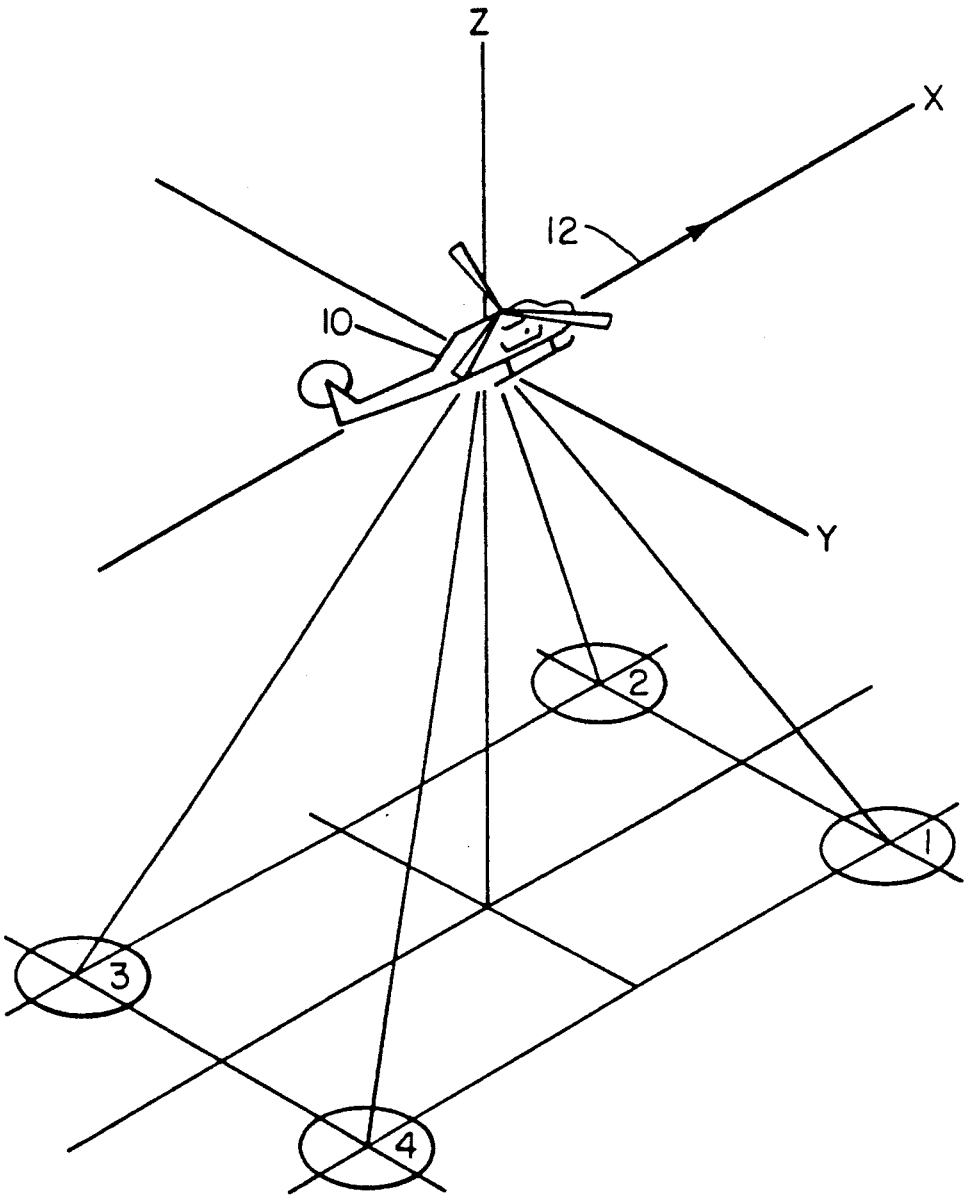
FIG. 1 illustrates four slanted beams radiated from a Doppler radar navigation system installed in a helicopter.

Referring now to the drawings, FIG. 1 illustrates an aircraft 10, illustratively a helicopter, which contains a Doppler radar navigation system. The fuselage of the aircraft 10 is constructed of a rectangularly intersecting pattern of ribs covered by a "skin". As is conventional, a planar microstrip antenna printed on a substrate is mounted in a rectangular aperture formed by the intersecting ribs in the underbelly of the aircraft 10. The antenna generates four slanted beams, their intersections with land or water over which the aircraft 10 is flying being designated 1, 2, 3 and 4. Thus, relative to the defined forward direction of travel 12 of the aircraft 10 along the X-axis, the beams 1 and 2 are slanted in a forward direction and the beams 3 and 4 are slanted in a rearward direction. Further, the beams 1 and 4 are slanted toward the right and the beams 2 and 3 are slanted toward the left. It is understood that each of the beams is actually a composite beam made up of a transmitted beam radiated from the antenna and a reflected beam received, or absorbed, by the antenna.

In a space duplexed antenna system, there are actually two separate antennas, one for the transmit function and one for the receive function. Both of the antennas must fit within a single rectangular aperture formed by the rectangular rib pattern of the aircraft 10. This aperture has a pair of sides parallel to the direction of forward travel 12 of the aircraft 10. In the past, to achieve the required sixty dB of isolation between the input/output ports of the transmit and receive antennas, each of the antennas would be on a respective side of a bisecting central axis of the aperture and therefore could only utilize half of the total aperture.

Figure 2A:
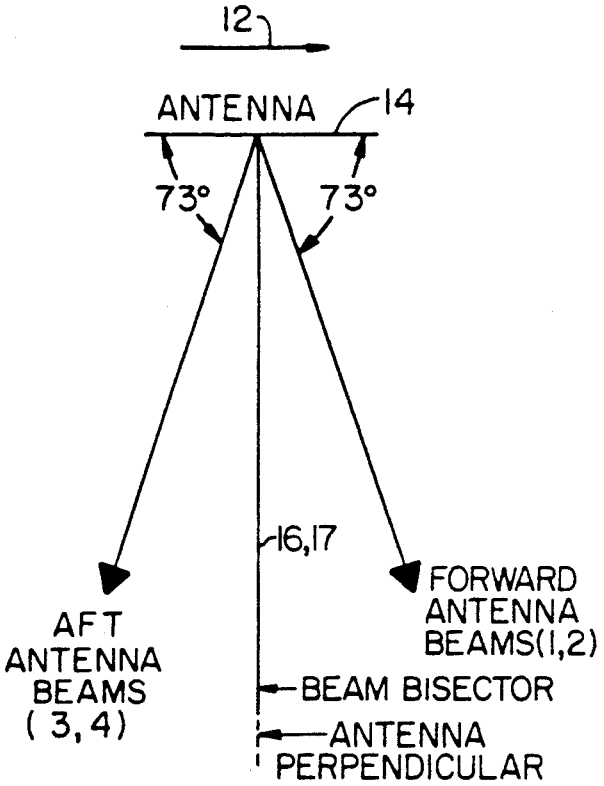
FIGS. 2A-2D illustrate various antenna beam pitch orientations relative the direction of travel of the aircraft, with FIG. 2A showing the condition of no pitch, FIG. 2B showing the transmit antenna beams being pitched 3° away from the feed and toward the forward direction of travel, FIG. 2C showing the receive antenna beams pitched 3° toward the feed and toward the forward direction of travel, and FIG. 2D showing the interleaved transmit and receive antenna beams pitched 3° toward the direction of travel.

Before describing the improved antenna system according to this invention, a brief discussion of antenna beam pitch and array spacing is appropriate, since the effect of these two properties on the coupling between arrays is critical to the design of an antenna system according to this invention. All Doppler antennas generate two pairs of beams, one pair pointing forward and the other pair pointing rearward (or aft). In an antenna having a crossover feed structure, as disclosed in the aforereferenced U.S. Pat. No. 4,605,931, one set of arrays produces the forward pointing pair of beams and another set of arrays produces the rearward pointing pair of beams. Conventionally, both sets of arrays are phased to create their respective beam pairs at equal angles (typically about 73°) from the antenna surface plane 14, as shown in FIG. 2A. This phasing results in maximum coupling of energy between the two sets of arrays within the antenna, thus requiring that a certain minimum spacing between arrays be maintained. If, however, the phasing of both sets of arrays is changed to tilt both sets of beams slightly more forward or rearward, the coupling between the sets of arrays becomes significantly lower and the spacing between arrays can then be reduced considerably, making the present invention possible. The attribute of beams which are tilted slightly with respect to the antenna surface plane 14 is known as beam pitch. The pitch angle is defined as the angle between the antenna perpendicular 16 (an imaginary line perpendicular to the antenna surface plane 14) and the line 17 bisecting the beam pair. Tests have demonstrated that reducing the array spacing has no effect on pitched-beam antenna performance.

Figure 2B:
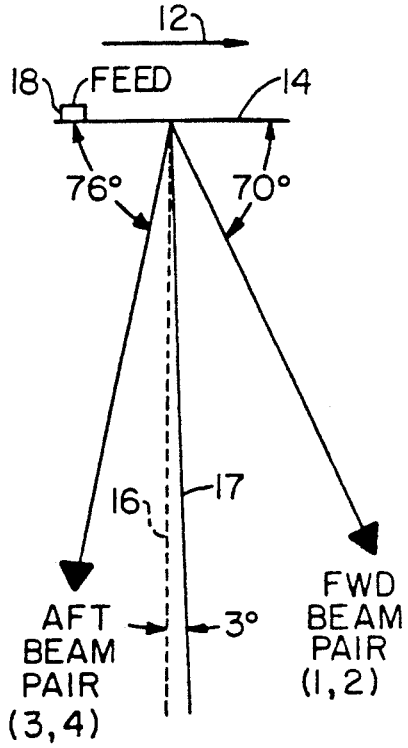
Figure 2C:
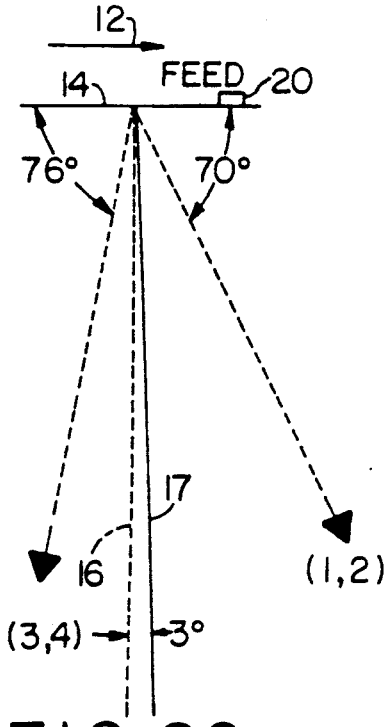
Figure 2D:
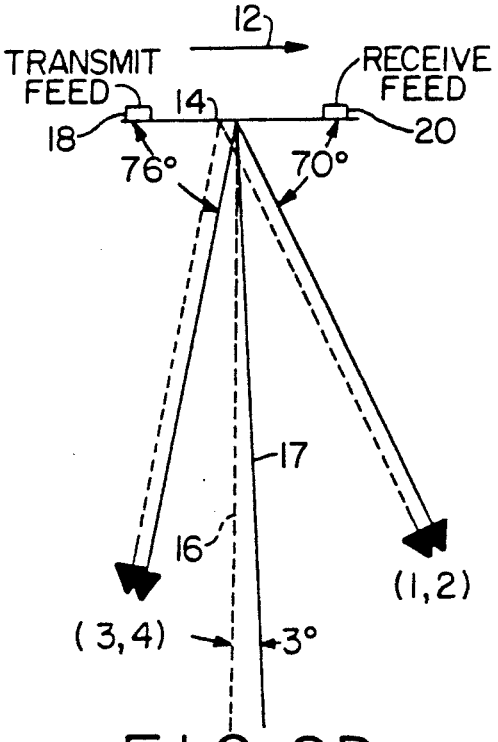

In accordance with the present invention and as will become clear from the following discussion, the transmit antenna has a crossover feed structure on the side of the transmit antenna toward the rear of the aircraft 10 and the receive antenna has a crossover feed structure on the side of the receive antenna toward the front of the aircraft 10. Thus, FIG. 2B illustrates the transmit antenna beams having a pitch angle of 3° away from the transmit feed 18 and toward the forward direction of travel 12 of the aircraft 10. Similarly, FIG. 2C illustrates the receive antenna beams having a pitch angle of 3° toward the receive antenna feed 20 and toward the forward direction of travel 12 of the aircraft 10. FIG. 2D illustrates the composite of the transmit and receive beams shown in FIGS. 2B and 2C which shows that together they have pitch angles of 3° toward the forward direction of travel 12 of the aircraft 10. When the aircraft 10 is a helicopter, as shown in FIG. 1, such aircraft typically travels in the forward direction with its normal orientation being that its nose is pitched downwardly about 3°. Therefore, with an antenna beam pitch angle of 3° forward, as shown in FIG. 2D, this results in the beam bisector 17 being substantially perpendicular to the land or water surface over which the aircraft 10 is flying, which is a preferred orientation for the beams.

Figure 3:
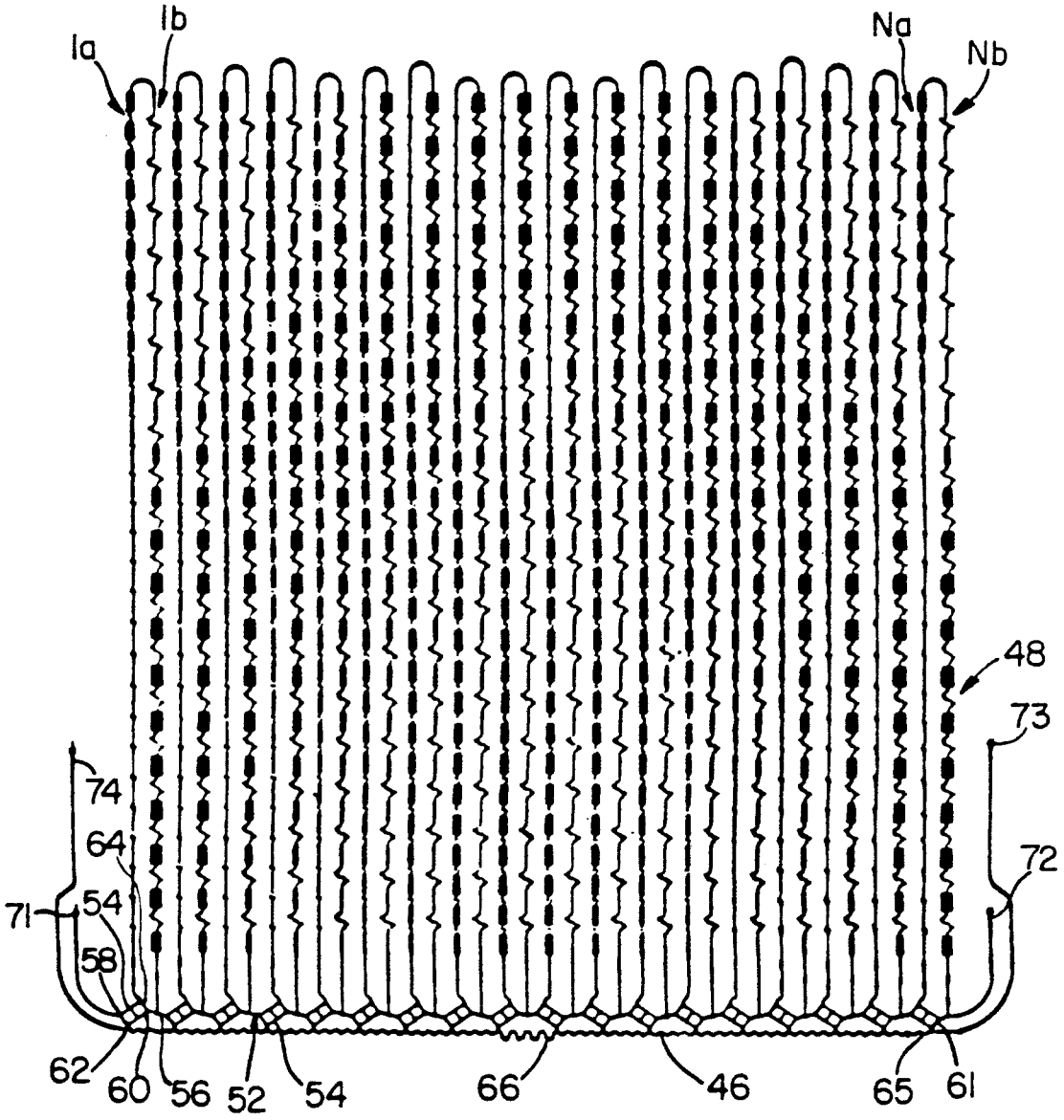
PRIOR ART FIG. 3
FIG. 3 illustrates a plan view of the radiating plane of the prior art interleaved antenna with crossover feeds of U.S. Pat. No. 4,605,931.

FIG. 3 illustrates a prior art crossover feed antenna which may be modified to practice the present invention. The antenna shown in FIG. 3 is the same as the antenna shown in FIG. 8 of U.S. Pat. No. 4,605,931, and retains the same reference numerals as in that patent. Thus, as shown in FIG. 3, a standard serpentine line 46 is used as the outer feed, accessing the arrays 1*a*-Na through the crossover feed and the crossover feed directly accesses the arrays 1*b*-Nb. As is known, one of the sets of arrays 1*a*-Na or 1*b*-Nb is a forward firing array and the other of the sets of arrays is a backward firing array. The inner crossover feed 52 includes interconnecting individual crossover structures 54 constituting a feed line generally parallel to the serpentine feed line 46. The arrays 48 and both feeds 46 and 52 are disposed in the same plane.

Concentrating upon the leftmost crossover feed structure, the first input port 58 is connected to the illustrated port terminal 71. The port 60 is diagonal to the port 58 and connects the leftmost crossover structure 54 with an adjacently interconnected crossover structure by connecting segment 56. This pattern of interconnected crossover structures is repeated along the length of the crossover feed 52 until the second port terminal 72 is connected to the port 61 of the rightmost positioned crossover structure. Interconnecting segment 56 of the leftmost crossover structure accesses the array 1*b* and this accessing pattern to the arrays is repeated for all evenly positioned arrays up to and including the array Nb.

The port terminal 74 is directly connected to the left end 62 of the serpentine feed line 46. This end of the serpentine feed is directly connected to a port of the leftmost positioned crossover structure as indicated in FIG. 3. The diagonally opposite port 64 of this crossover structure accesses the array 1*a*. Similar connections exist for the remaining crossover feed structures and all odd positioned arrays up to and including the array Na which communicates with the right end 65 of the serpentine feed line 46. The port terminal 73 is directly connected to the feed line right end 65, thereby completing the connections between the four port terminals 71, 72, 73 and 74 and the arrays 48. The serpentine curves 66 at the center of the serpentine feed line 46 are enlarged so as to achieve desired phase correction.

Figure 4:
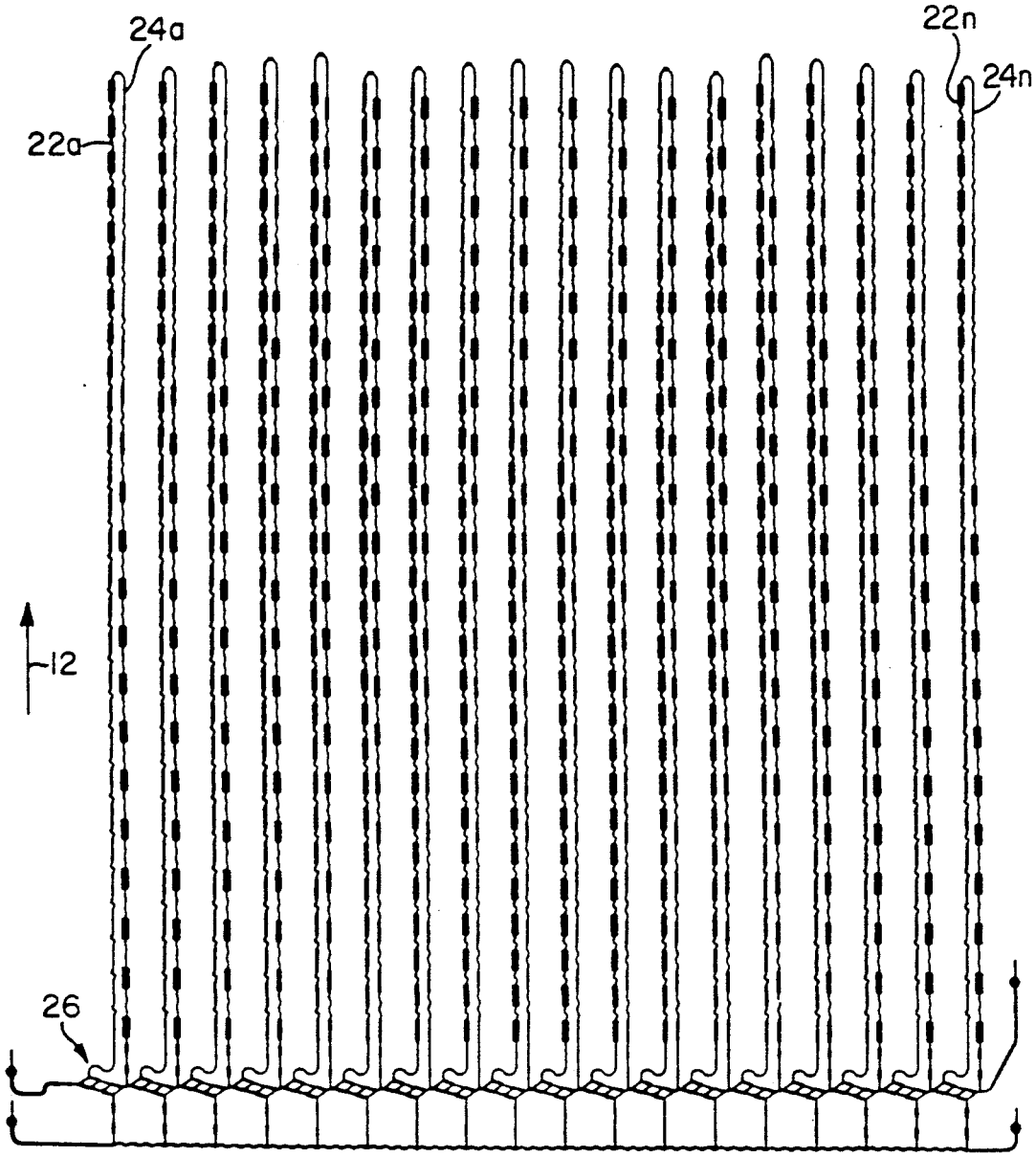
FIG. 4 is a plan view of the radiating plane of a crossover feed antenna with reduced array spacing according to this invention.

The full aperture interleaved space duplexed beam-shaped microstrip antenna system according to the present invention consists of two separate antennas of the general type shown in FIG. 3, each of which has been modified by reducing the spacing between the forward and the backward firing arrays in each connected array pair, as shown in FIG. 4. As previously described, this reduced spacing can be achieved by changing the phasings of the arrays to introduce a pitch angle to each of the beams. This is accomplished by varying the lengths of the phase links between the radiating patches. This introduction of pitch angle results in two advantages. The first advantage is that the coupling between the arrays is reduced so that the spacing can be reduced. The second advantage is that the pitch angle of the beams takes advantage of the normal flight orientation of the aircraft 10.

Thus, as shown in FIG. 4, each antenna includes a first array group 22 including a first plurality of parallel lines 22*a*, . . . , 22*n* of serially interconnected radiating rectangular patch elements wherein each of the first plurality of lines 22*a*, . . . , 22*n* is parallel to the forward direction of travel 12. The antenna further includes a second array group 24 including a second plurality of parallel lines 24*a*, . . . , 24*n* of serially interconnected radiating rectangular patch elements wherein each of the second plurality of lines 24*a*, . . . , 24*n* is parallel to the forward direction of travel 12. The first and second pluralities of lines are interleaved, with each of the first plurality of lines 22*a*, . . . , 22*n* being connected at a first end to a first end of a corresponding adjacent one of the second plurality of lines 24*a*, . . . , 24*n*. At the second ends of the first and second pluralities of lines is a crossover feed structure 26 which is utilized to feed the first and second array groups 22, 24 to create a pair of forwardly directed beams 1 and 2 and a pair of rearwardly directed beams 3 and 4. The first array group 22 is a backward firing array whereas the second array group 24 is a forward firing array.

As illustrated, the crossover feed 26 includes crossover feed structures each having a four port branch-arm hybrid structure. As shown in FIG. 4, by properly phasing the array groups to minimize the coupling between the backward firing lines 22*a*, . . . , 22*n* and the forward firing lines 24*a*, . . . , 24*n*, the spacing between adjacent connected oppositely firing lines can be reduced to less than half of the length of the diagonal of each hybrid structure, so as to provide room for another similar antenna to be interleaved between the connected line pairs, as will be described in full detail hereinafter.

Figure 5:
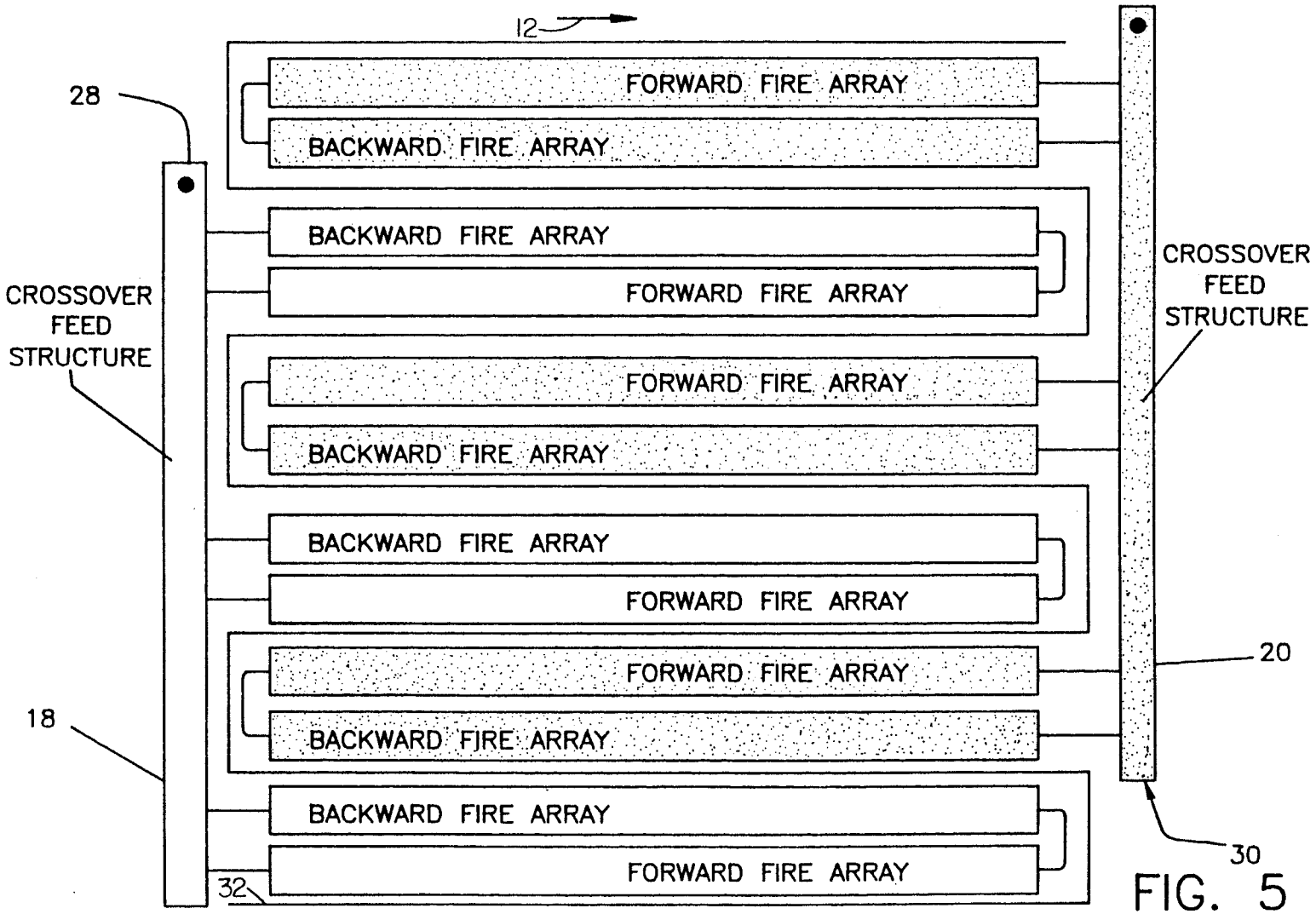
FIG. 5 schematically illustrates a full aperture interleaved antenna system according to this invention.

As schematically shown in FIG. 5, by reducing the spacing within each connected line pair within an antenna, it is possible to interleave a transmit antenna 28 and a receive antenna 30 so that they both make full use of the available aperture. The transmit antenna 28 and the receive antenna 30 are substantially identical, with the exception of their internal phasings so that the transmit antenna 28 has a beam pitch angle away from its feed 18 and the receive antenna 30 has a beam pitch angle toward its feed 20. When the antennas 28 and 30 are interleaved as shown in FIG. 5, it is noted that the forward firing array lines of the transmit antenna 28 are adjacent to the forward firing array lines of the receive antenna 30 and the backward firing array lines of the transmit antenna 28 are adjacent the backward firing array lines of the receive antenna 30. This contributes to reducing the coupling between the antennas 28 and 30.

Although there are no direct circuit connections between the transmit antenna 28 and the receive antenna 30, because of their proximity it is expected that there will be a certain degree of surface wave coupling between the antennas 28 and 30. Radiation from microstrip antennas is brought about by the presence of discontinuities in the antenna circuit. A discontinuity is any point in the circuit in which there is an abrupt change in the microstrip line, such as a corner, a sharp bend, or an abrupt change in width. A change in the electric field condition at these points causes a certain amount of energy to be radiated in the form of space waves, so called because they radiate into the space surrounding the antenna. Unfortunately, these discontinuities also generate surface waves, which propagate within the substrate layer between the microstrip circuit and the ground plane. The surface waves remain trapped in the substrate and can transmit energy to other parts of the circuit.

In a Doppler radar microstrip antenna of the type described, surface waves are generated at the edge of each radiating patch in an array. The degree of surface wave interaction, or coupling, within the antenna is therefore considerable, especially when the arrays are close together as in the present invention. Therefore, according to the present invention, in order to insure the minimum required sixty dB isolation between the ports of the transmit antenna 28 and the ports of the receive antenna 30, there is provided isolation means positioned between the lines of the transmit antenna 28 and the receive antenna 30 for reducing the mutual coupling therebetween. As shown in FIG. 5, the isolation means includes a continuous line of resistive material 32 separating the lines of the transmit antenna 28 from the lines of the receive antenna 30. The line of resistive material 32 substantially reduces the interaction between the surface waves generated at each discontinuity along the entire length of the arrays and makes it possible to achieve the required minimum sixty dB of isolation between the input/output ports of opposing antennas.

Figure 6:
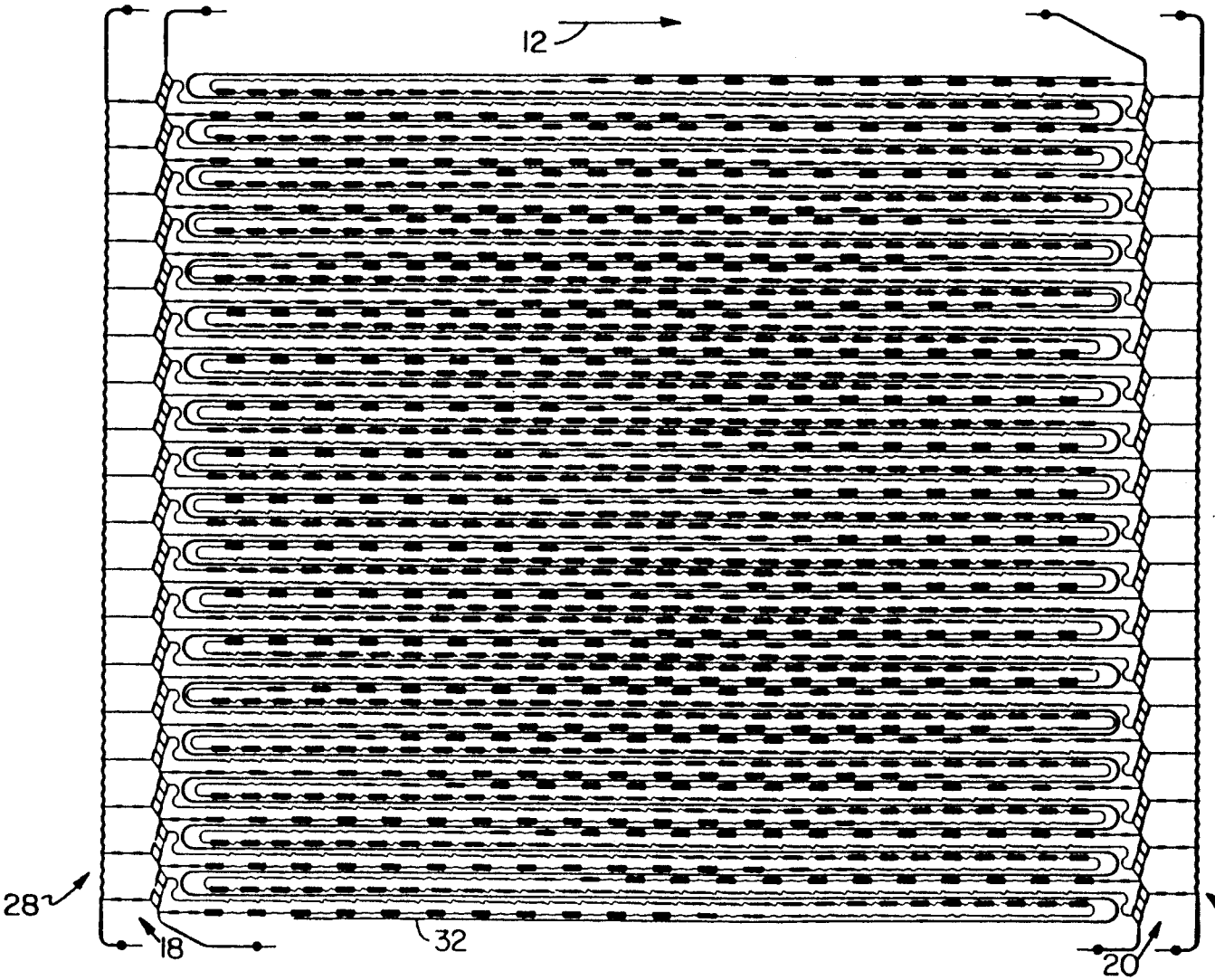
FIG. 6 is a plan view of the entire radiating plane of a full aperture interleaved space duplexed beamshaped microstrip antenna system constructed according to this invention.
Figure 7:
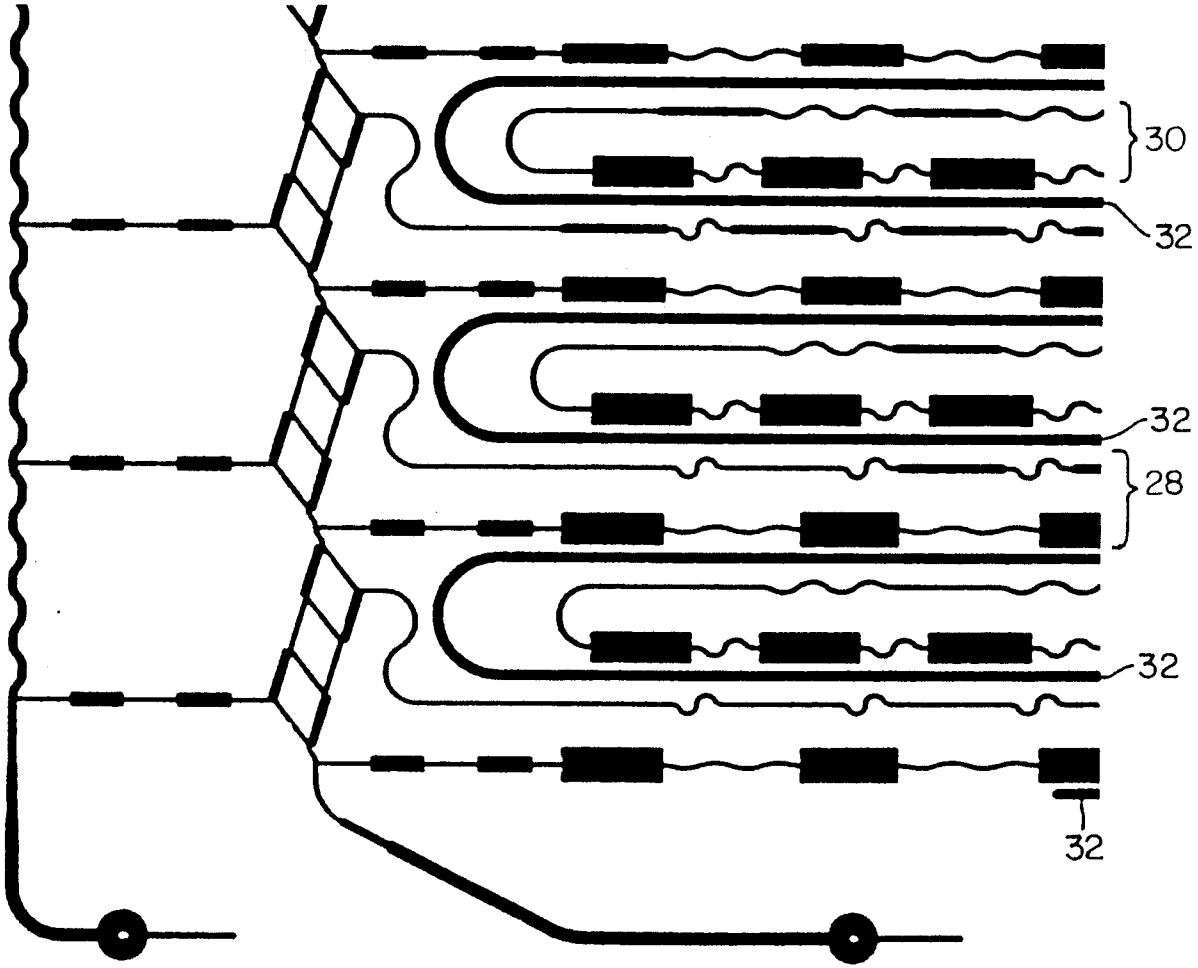
FIG. 7 is an enlarged view of a corner of the antenna system of FIG. 6.

FIG. 6 is a plan view of the entire radiating plane of a full aperture interleaved space duplexed beamshaped microstrip antenna system constructed according to this invention showing the resistive material line 32 being serpentine and completely separating the transmit antenna 28 from the receive antenna 30. FIG. 7 is an enlarged view of the lower left corner of FIG. 6. Thus, as shown, the transmit antenna 28 has its feed 18 at one end of the aperture and the receive antenna 30 has its feed 20 at the other end of the aperture. The parallel lines making up the transmit antenna 28 extend away from the feed 18 parallel to the forward direction of travel 12 and the plurality of lines making up the receive antenna 30 extend away from the feed 20 parallel to the forward direction of travel 12. The line pairs of each of the antennas are connected at their ends remote from their respective feeds and are phased to produce a beam pitch angle and reduce the coupling therebetween so that their spacings can be reduced to provide room for the interleaving of the line pairs of the other antenna, with the line of resistive material 32 separating the transmit antenna 28 from the receive antenna 30.

Figure 8:
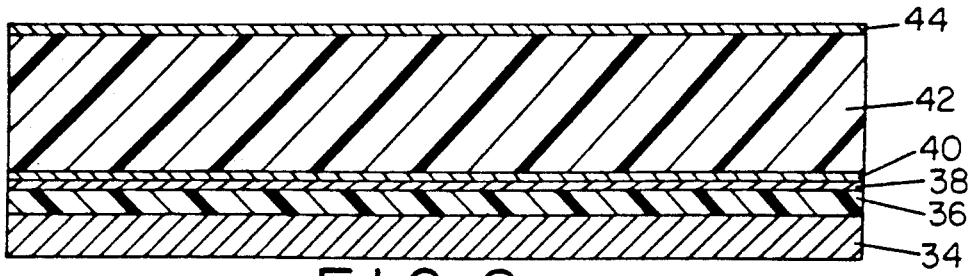
FIG. 8 is a cross sectional view of a preferred material laminate for constructing the antenna system of FIG. 6.

FIG. 8 is a cross sectional view of a preferred material laminate for constructing the antenna system of FIG. 6. The antenna system is made up of several layers, with the upper layer of FIG. 8 being the outer layer. The layer 34 is an aluminum ground plane and the layer 36 is a dielectric substrate. Preferably, the material making up the substrate 36 is Duroid 6002 made by Rogers Corporation, which has a dielectric constant which remains highly stable over temperature, thereby providing a high degree of antenna beam stability. The layer 38 is a resistive layer and the layer 40 is a copper foil layer. Preferably, the layers 38 and 40 are purchased as a resistive-backed copper foil made by Ohmega Technologies, Inc., under the trade name Ohmega-Ply. This material is laminated to the substrate 36. The layer 40 is then etched in a conventional manner to form the pattern for the transmit antenna 28 and the receive antenna 30. A second etching operation is then performed to produce the desired configuration of the line of resistive material 32. The layer 42 is a dielectric substrate making up the radome, preferably also formed of Duroid 6002 material. The layer 44 is copper foil and is etched to form a mask around the periphery of the aperture.

Accordingly, there has been disclosed an improved full aperture interleaved space duplexed beamshaped microstrip antenna system. This antenna system introduces a beam pitch angle which reduces the coupling within connected line pairs of each antenna. Because of this reduced coupling, the spacing within a connected line pair can be reduced, allowing the interleaving of transmit and receive antennas. The interleaved antennas each utilizes the entire aperture so that maximum gain is attained. Shielding between the antennas maximizes the isolation therebetween. While an illustrative embodiment of the present invention has been disclosed herein, it is understood that various modifications and adaptations to the disclosed embodiment will be apparent to those of ordinary skill in the art and it is only intended that this invention be limited by the scope of the appended claims.

I claim:

1. A planar microstrip antenna system for a Doppler radar navigation system of aircraft having separate arrays of radiating patch elements for the transmit and receive functions and which is compensated for temperature, frequency and overwater shifts, said antenna system filling a defined rectangular aperture having a pair of sides parallel to a defined direction of forward travel of the aircraft, said antenna system comprising:

a transmit antenna including:

a first array group including a first plurality of parallel lines of serially interconnected radiating rectangular patch elements wherein each of the first plurality of lines is parallel to the defined direction;

a second array group including a second plurality of parallel lines of serially interconnected radiating rectangular patch elements wherein each of the second plurality of lines is parallel to the defined direction, the second plurality of lines of said second array group being interleaved with the first plurality of lines of said first array group, with each of the second plurality of lines being connected at a first end to a first end of a corresponding adjacent one of said first plurality of lines; and transmit antenna feed means for feeding said first and second array groups from the second end of each of said first and second pluralities of lines to create a pair of forwardly directed beams and a pair of rearwardly directed beams; and a receive antenna including;

a third array group including a third plurality of parallel lines of serially interconnected radiating rectangular patch elements wherein each of the third plurality of lines is parallel to the defined direction;

a fourth array group including a fourth plurality of parallel lines of serially interconnected radiating rectangular patch elements wherein each of the fourth plurality of lines is parallel to the defined direction, the fourth plurality of lines of said fourth array group being interleaved with the third plurality of lines of said third array group, with each of the fourth plurality of lines being connected at a first end to a first end of a corresponding adjacent one of said third plurality of lines; and receive antenna feed means for feeding said third and fourth array groups from the second end of each of said third and fourth pluralities of lines to create a pair of forwardly directed beams and a pair of rearwardly directed beams;

wherein said transmit and receive antennas are interleaved so that between adjacent connected pairs of lines of said transmit antenna there is a connected pair of lines of said receive antenna, said transmit antenna feed means is adjacent the first end of the receive antenna lines, and said receive antenna feed means is adjacent the first end of the transmit antenna lines; and wherein the antenna system further comprises:

isolation means positioned between the lines of the transmit and receive antennas for reducing the mutual coupling between the transmit and receive antennas.

2. The antenna system according to claim 1 wherein the isolation means includes resistive material forming a continuous line between the lines of the transmit and receive antennas.

3. The antenna system according to claim 1 wherein:

said first array group of said transmit antenna is phased differently from said second array group of said transmit antenna so as to provide a predetermined pitch angle to the four transmit antenna beams and to reduce the coupling between said first and second array groups; and said third array group of said receive antenna is phased differently from said fourth array group of said receive antenna so as to provide said predetermined pitch angle to the four receive antenna beams in the same direction as the pitch angle of the four transmit antenna beams and to reduce the coupling between said third and fourth array groups.

4. The antenna system according to claim 3 wherein said predetermined pitch angle is approximately 3° toward the forward direction of travel.

5. The antenna system according to claim 3 wherein each of said transmit antenna feed means and said receive antenna feed means includes a respective crossover feed structure having a four port branch-arm hybrid structure and wherein the spacing between adjacent connected lines within each antenna is less than the spacing between adjacent non-connected lines within each antenna so that connected line pairs of the transmit and receive antennas may be interleaved within the spacing defined by the length of the diagonal of the hybrid structure, whereby two complete space duplexed antennas are contained within a common aperture with each antenna utilizing the entire common aperture.

6. The antenna system according to claim 5 wherein said predetermined pitch angle is approximately 3° toward the forward direction of travel.

7. The antenna system according to claim 5 wherein the isolation means includes resistive material forming a continuous line between the lines of the transmit and receive antennas.

* * * * *